US005520463A

United States Patent [19]

Tilman

[11] Patent Number: 5,520,463

[45] Date of Patent: May 28, 1996

[54] FOAMED ZIPPER

[75] Inventor: Paul A. Tilman, New City, N.Y.

[73] Assignee: Minigrip, Inc., Orangeburg, N.Y.

[21] Appl. No.: 453,142

[22] Filed: May 30, 1995

[51] Int. Cl.[6] ..... B65D 33/16

[52] U.S. Cl. ..... 383/63; 24/587

[58] Field of Search ..... 383/63; 24/587

[56] References Cited

U.S. PATENT DOCUMENTS 4,533,578 8/1985 Boyd et al. ..... 383/109 X 5,110,639 5/1992 Akao ..... 383/63 X

*Primary Examiner*—Jes F. Pascua

*Attorney, Agent, or Firm*—Kane, Dalsimer, Sullivan, Kurucz, Levy, Eisele and Richard

[57] ABSTRACT

A reclosable bag is formed of a first wall and a second wall of a polymeric sheet material joined to form an enclosure with a mouth defined by the wall edges. The bag has a closure for selectively opening and sealing the mouth. The closure includes a first and a second mutually interlocking profile, each of which extends along and is bonded to the internal surface of its respective first and second wall. The first and second mutually interlocking profiles are extruded from a synthetic polymeric resin material. For at least one of the first and second mutually interlocking profiles, the synthetic polymeric resin material is mixed with a blowing agent which provides the profile with a fine-celled foam structure.

16 Claims, 2 Drawing Sheets

FOAMED ZIPPER

BACKGROUND OF THE INVENTION

1. Field of the Invention

The present invention relates to the manufacture of plastic bags or packages having at least two plies of thermoplastic sheeting, both plies having closure strips included on their facing inner edges so as to form a zipper-like closure for the openings of the bags or packages made therefrom. The plies may be formed from two separate sheets or from a single sheet folded over. More specifically, in accordance with the present invention, the closure strips are extruded from a synthetic polymeric resin material including a blowing agent, which foams the closure strip to a desired and advantageous degree.

2. Description of the Prior Art

The present invention relates to improvements in the package-making art and may be practiced, without limitation, in the manufacture of thermoplastic bags and trays of the kind that may be used for various consumer products, but which are particularly useful for food products which must be kept in moisture- and air-tight packages, free from leakage until opened for access to the product contents, which packages are then reclosable by zipper means to protect any remainder of the product therein.

The indicated art is fairly well-developed, but nevertheless is still susceptible of improvements contributing to increased efficiency and cost effectiveness.

The zipper means alluded to in the above are most commonly male and female interlocking zipper profiles extruded from low density polyethylene (LDPE). These zipper profiles are usually attached to the polymeric sheet material, from which bags or packages are being produced, either during a separate bag formation operation or in conjunction with the bag filling operation on a form-fill-and seal (FFS) machine. The former providing empty bags to be separately filled while the later provides filled bags.

While FFS machines are of several specific designs, all comprise a filling tube, about which the bags or packages are formed and through which premeasured amounts of a consumer product, such as a food material, may drop as individual bags or packages are being produced in a sequential fashion. On the FFS machine, polymeric sheet material is directed toward and around the filling tube by means of a forming collar, the two lateral edges thereof being brought together to form a fin extending outward from and longitudinally along the filling tube. The male and female interlocking zipper profiles may be directed between the two lateral edges and are joined or heat-sealed thereto to form the facing inner portions of the reclosable bag opening.

As bags or packages are being produced and filled in a sequential fashion on an FFS machine, seals are made transversely across the polymeric sheet material and interlocked male and female zipper profiles to form the side seals of individual packages. Because of the bulk of the zipper profiles relative to that of the polymeric sheet material, the zipper profiles require some pre-seal treatment in the location where a side seal is to be made, so that the side seal may be complete and not permit any leakage of the contents of the package. Such pre-seal treatment includes the use of heat stompers (hot anvils which crush the zipper profiles at the location of the side seal to be subsequently made), ultrasonic welders (similar to heat stompers but employing ultrasonic energy), hole punchers (which remove a portion of the zipper profile where the side seal is to be applied), and milling cutters (which abrade away a portion of the zipper profile at the side seal location). The pre-seal treatment permits the cross sealing equipment to make a reasonable seal. It goes without saying that the pre-seal treatment of the zipper profiles is an extra manufacturing step which, unfortunately, does not entirely eliminate the occurrence of leaking packages, or "leakers".

The present invention is intended to reduce the extent of the pre-seal treatment required where a side seal is to be cut across a zipper profile, to reduce the occurrence of "leakers", and to improve the air tightness of the lock.

SUMMARY OF THE INVENTION

Accordingly, the present invention is a reclosable bag or package, and a closure therefor. The reclosable bag comprises a first wall and a second wall of polymeric sheet material joined to form an enclosure with a mouth defined by wall edges.

The reclosable bag also comprises a closure for selectively opening and sealing the mouth of the bag. The closure comprises a first and a second mutually interlocking profile. The first profile extends along and is bonded to an internal surface of the first wall, and may be a male interlocking profile. The second profile extends along and is bonded to an internal surface of the second wall, and may be a female interlocking profile.

Both the first and second mutually interlocking profiles are extruded from a synthetic polymeric resin material which may be low-density polyethylene (LDPE).

For at least one of the first and second mutually interlocking profiles, and optionally for both, the synthetic polymeric resin material is mixed with a blowing agent. This will provide one or both of the mutually interlocking profiles with a fine-celled foam structure.

The direct consequence of the fine-celled foam structure of one or both mutually interlocking profiles is the provision of a lower density therefor relative to that obtained without the use of a blowing agent. The lower density of the profile or profiles permits a good side seal to be made therethrough without the use of pre-seal equipment. With minimal pre-seal treatment, the occurrence of "leakers" can be drastically reduced or eliminated.

The present invention will now be described in more complete detail with frequent reference being made to the drawing figures identified below.

DETAILED DESCRIPTION OF THE PREFERRED EMBODIMENT

Figure 1:
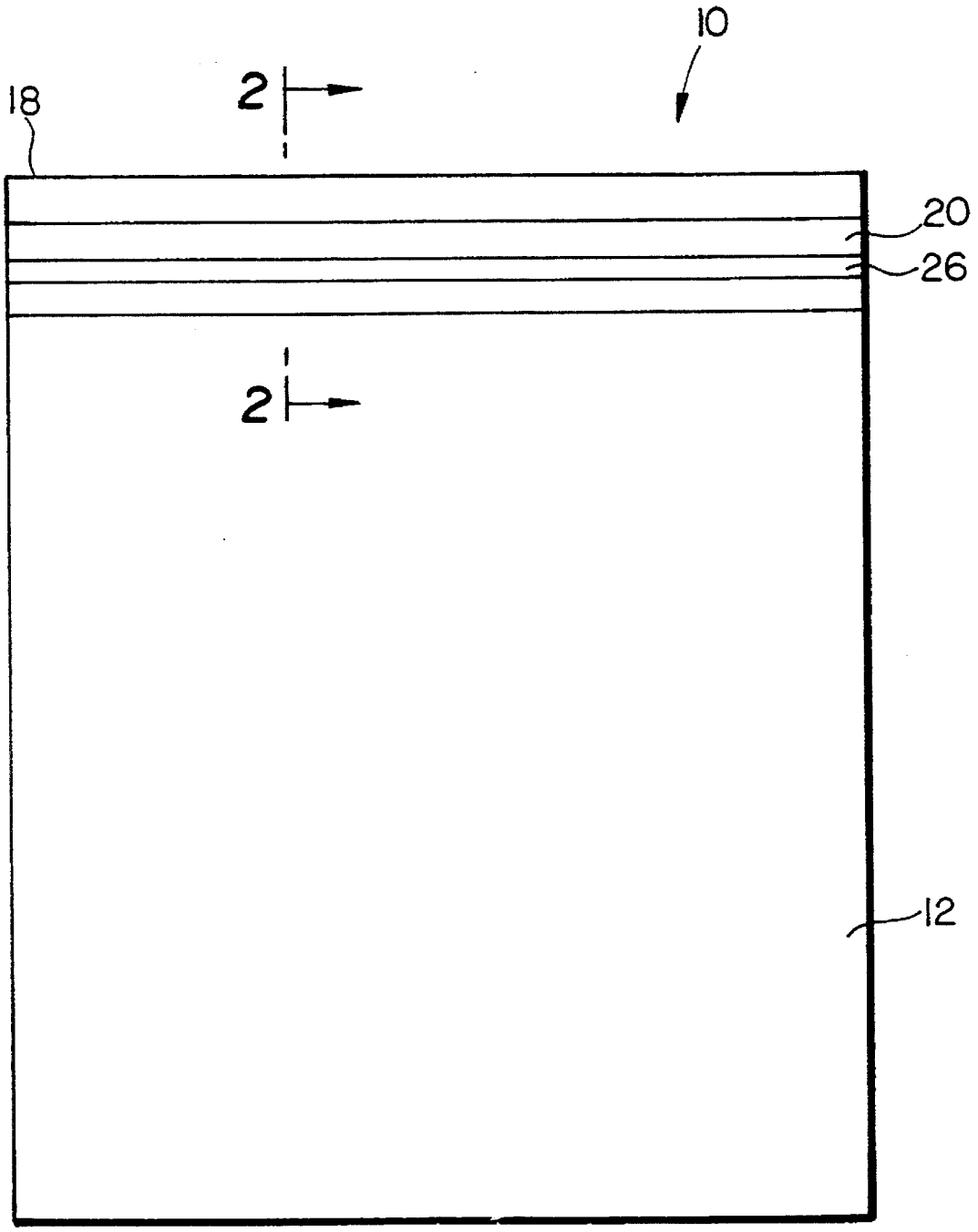
FIG. 1 shows a plan view of a reclosable bag constructed in accordance with the present invention.

Referring now to the drawings, a reclosable bag 10 constructed in accordance with this invention includes first (front) and second (rear) walls 12, 14 seamed along two, or possibly three, edges thereby forming an enclosure with an opening or mouth 16 along the top or fourth edge 18. The bag 10 is preferably made from a polymeric sheet material. One such material may be polyethylene, of which the sheet material may be formed by extrusion.

Figure 2:
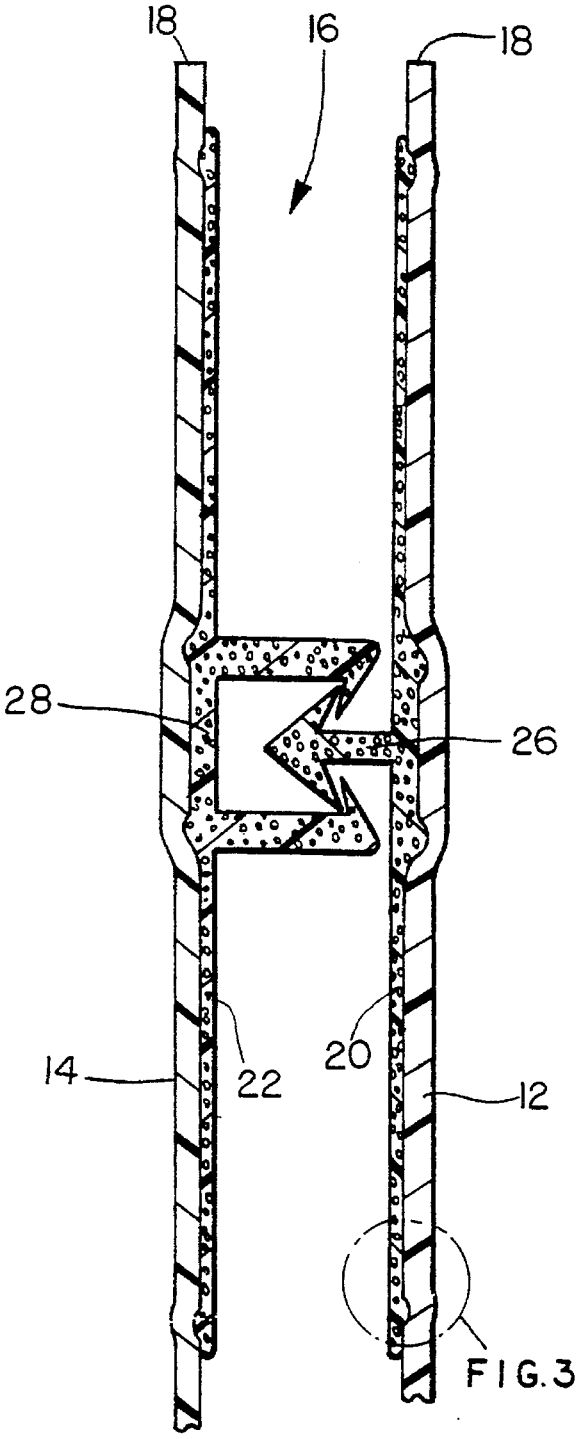
FIG. 2 shows an enlarged side sectional view of the bag opening.

With specific reference to FIG. 2, first wall 12, has attached and bonded thereto a first mutually interlocking profile strip 20, while second wall 14 has attached and bonded thereto a second mutually interlocking profile strip 22. The first mutually interlocking profile strip 20 may be a male interlocking profile, as suggested by male interlocking member 26. In like manner, the second mutually interlocking profile strip 22 may be a female interlocking profile, as suggested by female interlocking member 28. While a specific variety of male and female interlocking profiles has been illustrated in FIG. 2, it should be understood that this is intended to be an example only, and that the present invention may be practiced with mutually interlocking profiles of all types.

Figure 3:
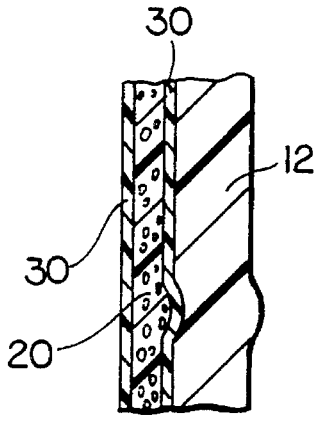
FIG. 3 shows an enlarged fragmentary side sectional view of a portion of the bag opening showing a profile produced in accordance with an alternate embodiment of the present invention.

First and second mutually interlocking profile strips 20, 22 may be extruded from a synthetic polymeric resin material, such as low-density polyethylene (LDPE). The synthetic polymeric resin material for one or both of the profile strips 20, 22 may be mixed with a blowing agent, which will provide the profile or profiles with a fine-celled foam structure. The blowing agent may be included in an amount less than or equal to 5% of the synthetic polymeric resin material by volume. The entire profiles 20 and 22 may be extruded of the foamed material or the foamed material may be encapsulated within a skin or casing 30 of polymeric resin material to which no blowing agent has been added as shown in FIG. 3. In the later case, the foamed profiles and casing may be coextruded.

Blowing agents are well known to those of ordinary skill in the plastics arts. A suitable blowing agent for the practice of the present invention is HYDROCEROL® CF 40 E, which is available from B.I. Chemicals, Inc., Henley Division, 50 Chestnut Ridge Road, Montvale, N.J. 07645.

The present invention offers several distinct advantages to the manufacturers of zipper profiles for the plastic bag and package industry. The decreased density of the zipper, which may be referred to as a "density-reduced zipper", allows it to be subjected to side sealing without the normally accompanying risk of leaking packages. The requirement for pre-seal treatment of the zipper may be minimized, with the result that the manufacturing process may be accelerated.

Further, the blowing agent increases the size (i.e. cross-sectional area) of the profiles without increasing the mass of the zipper in the side seal area. Not only does this improve the mutual interlocking of the profiles, but it also permits a given quantity of synthetic polymeric resin material to be extruded into a greater length of zipper profile.

In addition, the present invention has the unexpected advantage of improving the adhesion of surface modifying agents onto the interlocking portions of the zipper profiles. As low-density polyethylene is sticky when first extruded, practitioners normally add a material (surface modifying agent) to control (that is, to promote) slippage. While polyethylene is ordinarily resistant to surface modifying materials, the foamed zipper of the present invention is more receptive to such coatings.

Many other advantages will become apparent to those of ordinary skill in the art. Obviously, numerous modifications may be made to this invention without departing from its scope as defined in the appended claims. For example, the blowing agent tends to reduce the stiffness and hence the strength of the profiles, it may be desirable to add blowing agent to only one of the profiles or to only a part of one or both profiles.

What is claimed is:

1. A reclosable bag comprising:

a first wall and a second wall joined to form an enclosure with a mouth defined by wall edges; and a closure for selectively opening and sealing said mouth, said closure comprising a first and a second mutually interlocking profile, said first profile extending along and bonded to an internal surface of said first wall and said second profile extending along and bonded to an internal surface of said second wall, wherein said first and second mutually interlocking profiles are extruded from a synthetic polymeric resin material, and wherein for at least one of said first and second mutually interlocking profiles said synthetic polymeric resin material is mixed with a blowing agent which provides it with a fine-celled foam structure.

2. A reclosable bag as claimed in claim 1 wherein said fine-celled foam structure of said at least one of said interlocking profiles is encapsulated within non-foamed polymeric resin material.

3. A reclosable bag as claimed in claim 1 wherein for both of said first and second mutually interlocking profiles said synthetic polymeric resin material is mixed with a blowing agent.

4. A reclosable bag as claimed in claim 1 wherein said blowing agent is included in said synthetic polymeric resin material in an amount less than or equal to 5% thereof by volume.

5. A reclosable bag as claimed in claim 3 wherein said blowing agent is included in said synthetic polymeric resin material in an amount less than or equal to 5% thereof by volume.

6. A reclosable bag as claimed in claim 1 wherein said synthetic polymeric resin material is low density polyethylene (LDPE).

7. A reclosable bag as claimed in claim 1 wherein said first mutually interlocking profile is a male interlocking profile.

8. A reclosable bag as claimed in claim 1 wherein said second interlocking profile is a female interlocking profile.

9. A closure for selectively opening and sealing the mouth of a reclosable bag, said closure comprising:

a first mutually interlocking profile and a second mutually interlocking profile, said first and second mutually interlocking profiles being extruded from a synthetic polymeric resin material, wherein, for at least one of said first and second mutually interlocking profiles, said synthetic polymeric resin material is mixed with a blowing agent which provides it with a fine-celled foam structure.

10. A reclosable bag as claimed in claim 9 wherein said fine-celled foam structure of said at least one of said interlocking profiles is encapsulated within non-foamed polymeric resin material.

11. A closure as claimed in claim 9 wherein for both of said first and second mutually interlocking profiles said synthetic polymeric resin material is mixed with a blowing agent.

12. A closure as claimed in claim 9 wherein said blowing agent is included in said synthetic polymeric resin material in an amount less than or equal to 5% thereof by volume.

13. A closure as claimed in claim 11 wherein said blowing agent is included in said synthetic polymeric resin material in an amount less than or equal to 5% thereof by volume.

14. A closure as claimed in claim 9 wherein said synthetic polymeric resin material is low density polyethylene (LDPE).

15. A closure as claimed in claim 9 wherein said first mutually interlocking profile is a male interlocking profile.

16. A closure as claimed in claim 9 wherein said second mutually interlocking profile is a female interlocking profile.

* * * * *